US006206795B1

(12) United States Patent
Ou

(10) Patent No.: US 6,206,795 B1
(45) Date of Patent: Mar. 27, 2001

(54) BASKETBALL WITH CUSHION LAYERS

(76) Inventor: Tsung Ming Ou, No. 32, Lane 56, Chung Cheng 2nd Road, Kaohsiung (TW)

( * ) Notice: Subject to any disclaimer, the term of this patent is extended or adjusted under 35 U.S.C. 154(b) by 0 days.

(21) Appl. No.: 09/362,524

(22) Filed: Jul. 28, 1999

(51) Int. Cl.[7] ..... A63B 41/08
(52) U.S. Cl. ..... 473/599; 473/604
(58) Field of Search ..... 473/599, 603, 473/604, 605, 607, 608, 609

(56) References Cited

U.S. PATENT DOCUMENTS 2,214,179 * 9/1940 Reach ..... 473/604
2,280,314 * 4/1942 Scudder ..... 473/604
3,506,265 * 4/1970 Yugi ..... 473/604
3,508,750 * 4/1970 Henderson ..... 473/605
4,462,590 * 7/1984 Mitchell ..... 473/603
5,542,662 * 8/1996 Kouzai et al. ..... 473/605
5,681,233 * 10/1997 Guenther et al. ..... 473/604
5,752,890 * 5/1998 Shishido et al. ..... 473/604
6,099,423 * 8/2000 Ou ..... 473/604

* cited by examiner

*Primary Examiner*—Steven Wong
(74) *Attorney, Agent, or Firm*—Raymond Y. Chan; David and Raymond Patent group

(57) ABSTRACT

A basketball, which is more durable and has a softer feeling to reduce the painful during ball passing and shooting, especially suitable for children, training players and amateur players, includes a spherical bladder carcass and a plurality of cover panels. The bladder carcass has a plurality of projection ribs integrally protruded and extended thereon to define eight leaf shape panel recesses surrounding by the ribs. Each of the cover panel has a shape of each of the panel recesses adapted to adhere in the eight panel recesses respectively. Each of the cover panels includes a cover layer and an additional cushion layer made of foam material having a top surface integrally adhered to the lining layer and a bottom surface for adhering a lining cloth thereto, wherein each side of the cushion layer is inwardly inclined for fitting in the respective panel recess.

5 Claims, 8 Drawing Sheets

BASKETBALL WITH CUSHION LAYERS

BACKGROUND OF THE PRESENT INVENTION

1. Field of the Invention

The present invention relates to basketball, and more particularly to a basketball having improved playing characteristics.

2. Description of Related Arts

Conventional basketball, as shown in FIG. 1, generally comprises a spherical bladder carcass 11 which is a hollow rubber ball having a valve stein affixed thereto. The bladder carcass 11 has a plurality of projection ribs 111 integrally protruded and extended thereon to define eight leaf shape panel recesses 112 surrounding by the ribs 111. The two vertical sides of each rib form two extending edges of each panel recess 112, which are generally perpendicular to the bottom surface 113 of the panel recesses 112, i.e. the outer surface of the bladder carcass 11.

The basketball further comprises eight leaf shaped cover panels 12 having a shape of each of the panel recesses 112 adapted to affix in the eight panel recesses 112 respectively. Each of the cover panels 12 is made of leather or synthetic leather such as polyurethane (PU) or polyvinyl chloride (PVC). As shown in FIG. 1, the synthetic leather made of cover panel 12 is composed of an outer coating layer 121 and an inner lining layer 122 integrally attached and supported under the outer coating layer 121.

The rigidity and durability of a conventional basketball as described above merely depend on the cover panels 12 but not the soft rubber bladder carcass 11. The structure of the cover panels 12 must be tough enough to absorb all the impact force. Therefore, the outer coating layer 121 of each of the cover panels 12, no matter it is made of leather or synthetic leather, must be further strengthened by affixing one more layer of coarsely lining 122 thereon in order to better support the outer coating layer 121 and resist the stress. The roundness and re-enforcement of the basketball depend on the strength of the lining cloth.

The coarse lining layer 122 of each of the cover panels 12 generally increases the hardness and toughness of the ball cover 11 but fails to provide a comfortable gripping and better rebounding characteristics. In fact, the leather or the thickened and hardened synthetic leather cover panels 12 of the conventional basketball may make the basketball player feels hurt and pain during ball passing and shooting activities, especially to children and those amateur players. In other words, for children and training basketball players or amateur players, the conventional basketball would be too rigid and hard for them.

SUMMARY OF THE PRESENT INVENTION

In order to improve the above drawbacks of the conventional basketball, the applicant first concepts to replace the lining layer 122 with a foam layer. However, the cover panel becomes not hard and tough enough. However, if an additional foam layer is adhered to the conventional cover panel, another unsolvable problem appears, that is the edges of the foam layers fail to rigidly adhere with the vertical sides of the ribs 111 of the bladder carcass 11 while the thickness of the ribs 111 is standardized.

Accordingly, it is a main object of the present invention to provide a basketball having a plurality of panel recesses thereon specifically adapted for firmly affixing a plurality of cover panels each of which comprising an additional foam layer attached to the conventional cover panel, so as to construct a basketball not only retaining the original characteristic of durable, hardness and toughness but also containing new characteristics of being easier to grip and having better rebounding feature.

It is another object of the present invention to provide a basketball which is more durable and has a softer feeling to reduce the painful during ball passing and shooting, especially suitable for children, training players and amateur players.

Accordingly, a basketball of the present invention is provided to accomplish the above objects, which comprises a spherical bladder carcass which is a hollow rubber ball having a valve stem affixed thereto. The bladder carcass has a plurality of projection ribs integrally protruded and extended thereon to define eight leaf shape panel recesses surrounding by the ribs. Each of the ribs is structured in wedge shaped having two inwardly inclined sides to form two extending inclined edges for each panel recess, so that each of the ribs has a slightly narrower root and a slightly wider top end.

The basketball further comprises eight leaf shaped cover panels having a shape of each of the panel recesses adapted to adhere in the eight panel recesses respectively. Each of the cover panels comprises a cover layer made of leather or synthetic leather such as polyurethane (PU) or polyvinyl chloride (PVC). The synthetic leather made cover panel is composed of an outer coating layer and an inner lining layer integrally attached and supported under the outer coating layer. Each of the cover panels further comprises an additional cushion layer made of foam material having a top surface integrally adhered to the lining layer and a bottom surface for adhering a lining cloth thereto, wherein each side of the cushion layer is inwardly inclined for fitting in the respective panel recess.

DETAILED DESCRIPTION OF THE PREFERRED EMBODIMENTS

Figure 2:
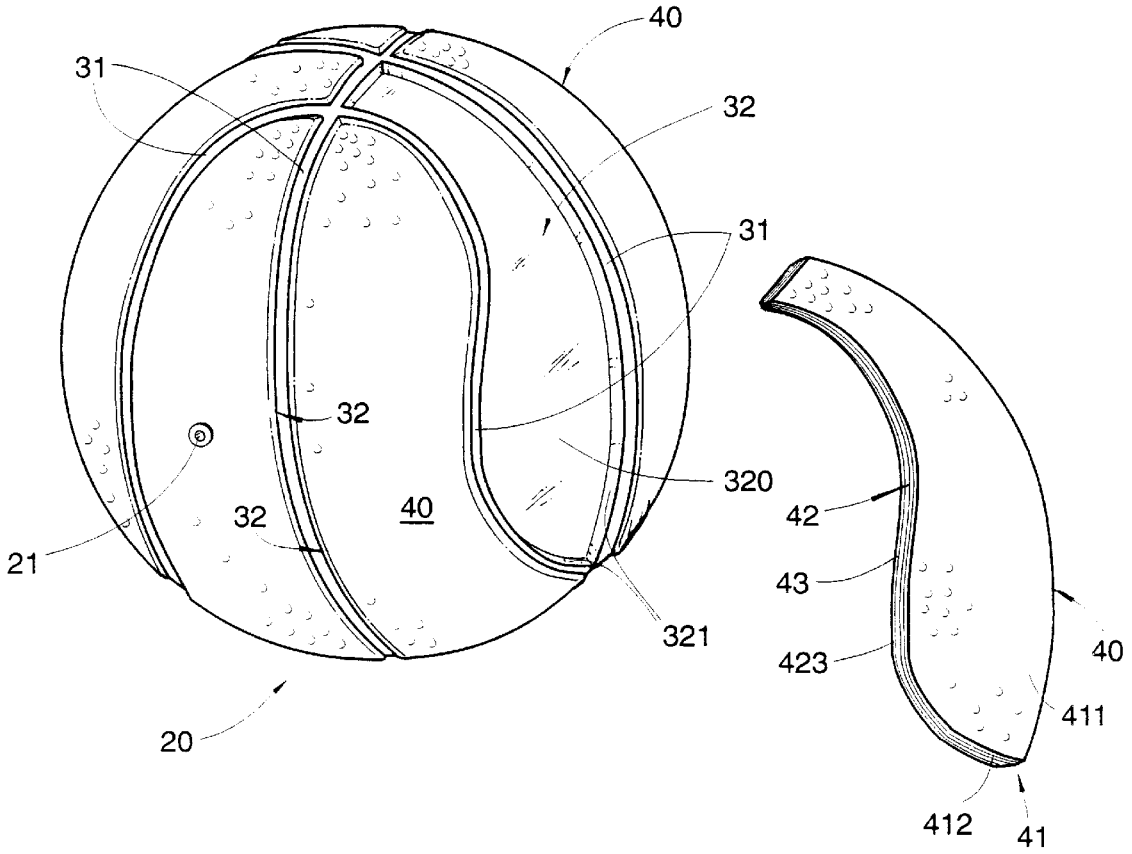
FIG. 2 is a partially exploded perspective view of a basketball according to a preferred embodiment of the present invention.
Figure 3:
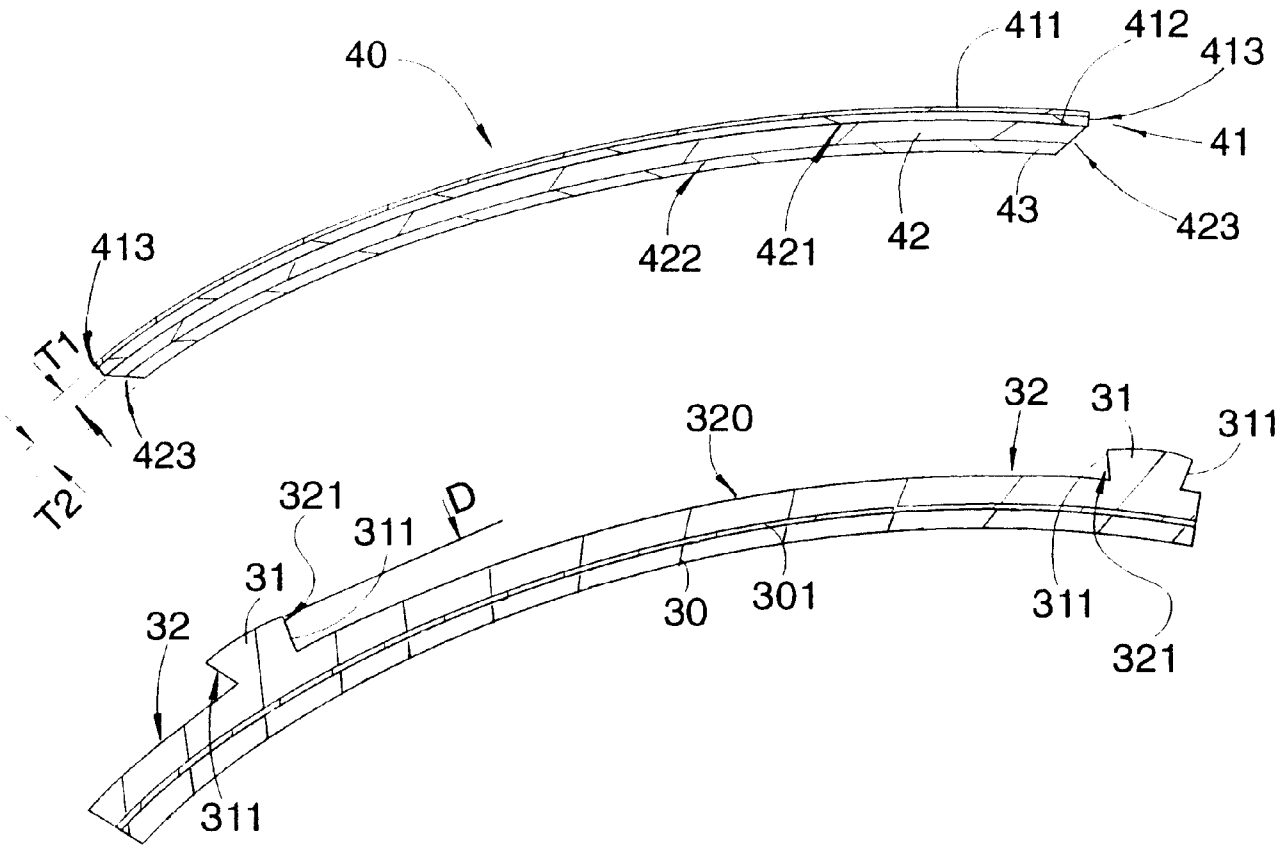
FIG. 3 is a partial exploded sectional view of the basketball according to the above preferred embodiment of the present invention.
Figure 4:
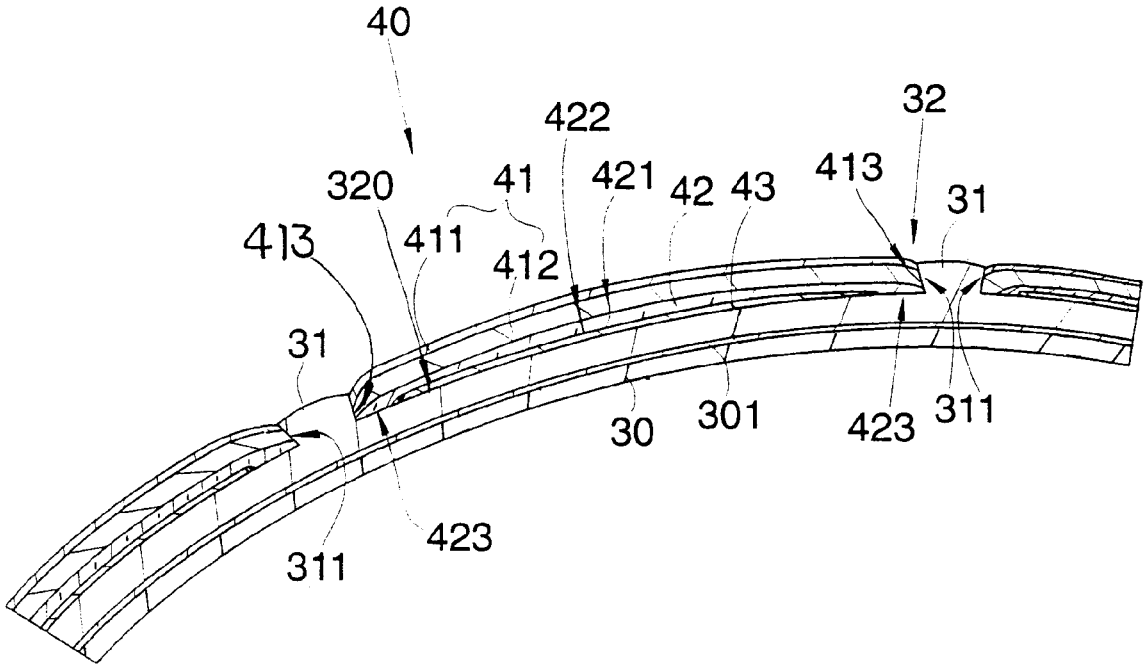
FIG. 4 is a partial sectional view of the basketball according to the above preferred embodiment of the present invention.

Referring to FIGS. 2 to 4, a basketball 20 according to a preferred embodiment of the present invention is illustrated, which comprises a spherical bladder carcass 30 which is a hollow rubber ball having a reinforcing lining layer 301 enclosed therein and a valve stem 21 affixed thereto. The bladder carcass 30 has a plurality of projection ribs 31 integrally protruded and extended thereon to define eight leaf shape panel recesses 32 surrounded by the ribs 31. Each of the ribs 31, having a wedge shaped cross section, has two inwardly inclined sides 311 to form two extending inclined edges 321 for each panel recess 32, so that each of the ribs 31 has a slightly narrower root and a slightly wider top end.

The basketball 20 further comprises eight leaf shaped cover panels 40 having a shape of each of the panel recesses 32 adapted to adhere in the eight panel recesses 32 respectively. Each of the cover panels 40 comprises a cover layer 41 made of leather or synthetic leather such as polyurethane (PU) or polyvinyl chloride (PVC). According to the preferred embodiment as shown in FIGS. 3 and 4, the synthetic leather made cover layer 41 is composed of an outer coating layer 411 and an inner lining layer 412 integrally attached and supported under the outer coating layer 411. Each of the cover panels 40 further comprises an additional cushion layer 42 made of foam material having a top surface 421 integrally adhered to the lining layer 412 and a bottom surface 422 for adhering a lining cloth 43 thereto, wherein each side edge 423 of the cushion layer 42 is inwardly inclined for fitting in the respective panel recess 32.

Figure 1:
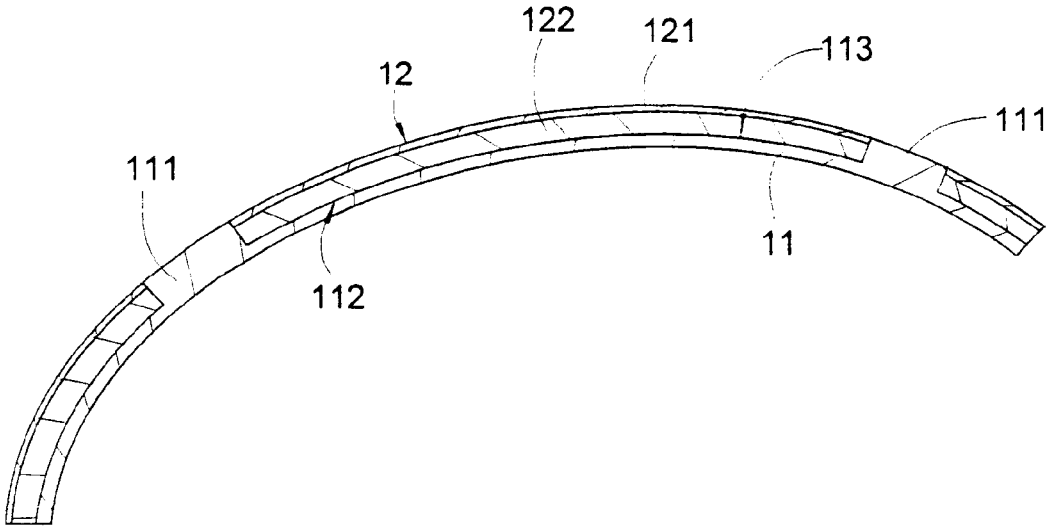
FIG 1 Prior Art
FIG. 1 is a partial sectional view of a conventional basketball.

Generally, as shown in FIG. 1, each of the panel recesses 112 is preferred to have a depth of 1 mm to 1.4 mm. Besides, the thickness of the conventional cover panel 12 is 1 mm to 1.4 mm too, so as to fittedly fill up the panel recess 112 with the cover panel 12, wherein the sides of the cover panel 12 are arranged to fully adhere to the edges of the ribs 111. Although any person who skill in art would know the use of a foam or sponge layer attached under a surface can provide a cushion effect, the difficulty of applying such concept to a basketball is the fact that the general material, such as EVA, PU foam, or sponge, of the cushion layer 42 can not well adhere with the rubber nature of the sides 311 of the ribs 31.

Besides, since the standard depth of the panel recess 32 is 1 to 1.4 mm, even though a thin cushion layer 42 is simply attached to the cover layer 41, the overall thickness of the cover panel 40 will render most of side edges of the cover layer 41 exceed the panel recess 32 and having no adhesive with the sides 311 of the ribs 31. Therefore, the attachment of the cover panel 40 in the panel recess 32 becomes very weak and may produce spur edges along ribs 31. No basketball player would like to play a basketball like this.

If the thickness, 1 mm to 1.4 mm, of the cover layer 41 is reduced so as to maintain the overall thickness of the cover panel 40, including the cover layer 41 and the cushion layer 42, equal to 1 mm to 1.4 mm so as to fit the size of the panel recess 32. The toughness of the basketball reduces according to the thinner cover layer that will made the basketball becomes less durable.

As shown in FIGS. 3 and 4, the applicant of the present invention successfully solves all of the above problems by rigidly attaching a specifically designed cushion layer 42 under the cover layer 41, wherein each of the cushion layers 42 has a bottom lining cloth 43 attached thereunder and inclined side edges 423. In other words, the side edges 423 of the cushion layer 42 is made inwardly inclining from its top to bottom, so that the size of the bottom surface of the cushion layer 42 as well as the lining cloth 43 is slightly smaller than the size of the cover layer 41.

According to the preferred embodiment of the present invention, the cover layer 41 can be structured as the conventional cover panel 12 as shown in FIG. 1 to have a thickness T1 of 1 mm to 1.4 mm that is arranged equal to a standard depth D, 1 mm to 1.4 mm, of each of the panel recesses 32. As shown in FIGS. 3 and 4, all covering side edges 413 of the cover layer 41 remain vertical. Moreover, the overall thickness T2 of the cushion layer 42 and the lining cloth 43 is preferred to be 1.2 mm to 2 mm while the thin thickness of the lining cloth 43 is preferred less than 1 mm.

As shown in FIG. 4, to attach each of the cover panels 40 in the respective panel recess 32, the cover panel 40 is first placed on a bottom surface 320 of the panel recess 32, wherein the lining cloth 43 of the cover panel 40 is firmly adhered to the bottom surface 320. Moreover, all the inclined side edges 423 of the cushion layer 42 are also pressed down around the lining cloth 43 to adhere on the borders of the bottom surface 320. At that moment, the vertical covering side edges 413 of the cover layer 41 will be pull down to contact with the sides 311 of the ribs 31 around the panel recess 32, so that the covering side edges 413 of the leather made or synthetic leather made cover layer 41 can be fittingly well adhered with the sides 311 of the ribs 31, i.e. the inclined edges 321 of the panel recess 32. Accordingly, the cover panel 40 with cushion layer 42 of the present invention can firmly adhered on the respective panel recess 32 while all side edges of the cover panel 40 perfectly connect with the ribs 31. Moreover, the thickness of the cushion layer 42 can also substantially prop up the cover layer 41, as shown in FIG. 4, which not only can facilitate the player to grip and hold the basketball, but also provide a more full and 3-dimensional appearance for the basketball than any conventional basketball (as shown in FIGS. 2 and 4).

Furthermore, the inclined edges 321 of the panel recess 32 provide more room for the inclined side edges 423 of the cushion layer 42 and the covering side edges 413 of the cover layer 41 to perfectly fill and provide a smooth attachment and connection.

Figure 5:
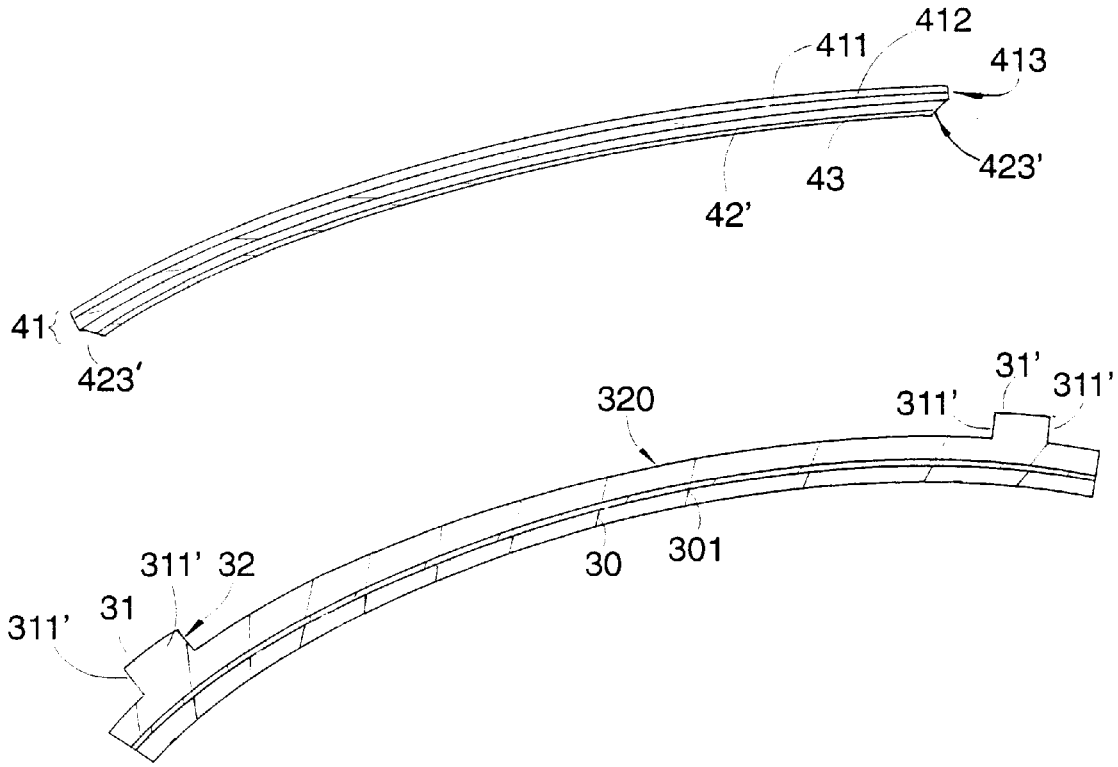
FIG. 5 is a partial exploded sectional view of an alternative mode of the basketball according to the above preferred embodiment of the present invention.
Figure 6:
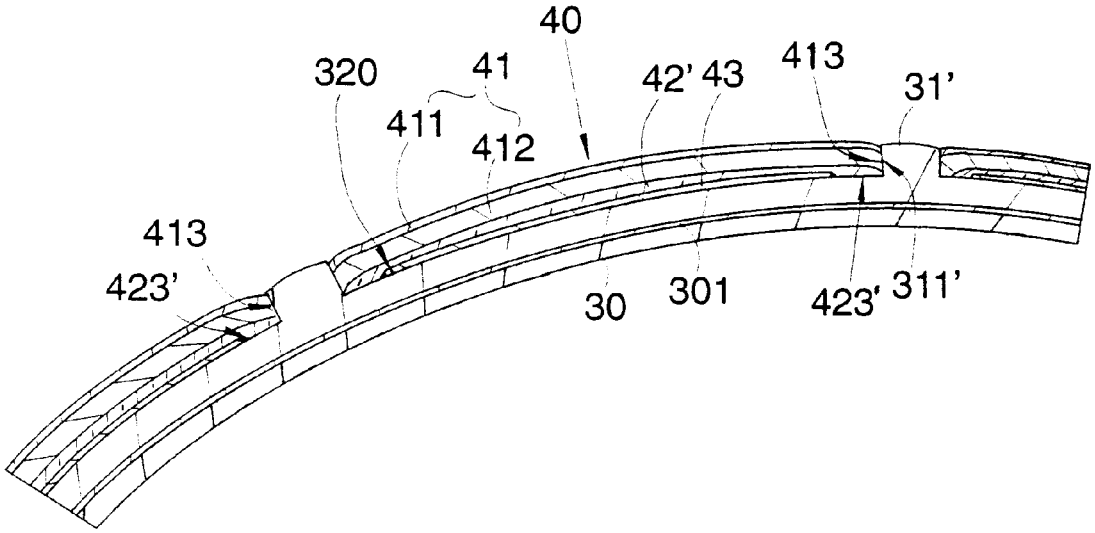
FIG. 6 is a partial sectional view of the alternative mode of the basketball according to the above preferred embodiment of the present invention.

Alternatively, as shown in FIGS. 5 and 6, the two sides 311' of each rib 31' can also be made in vertical manner under certain circumstances such as when a thinner cushion layer 42' is used, wherein the inclined side edges 423' of the cushion layer 42' are also adhered on around the lining cloth 43 on the bottom surface 320, and the covering side edges 413 of the cover layer 41 are all adhered with the vertical sides 311' of the ribs 31.

Figure 7A:
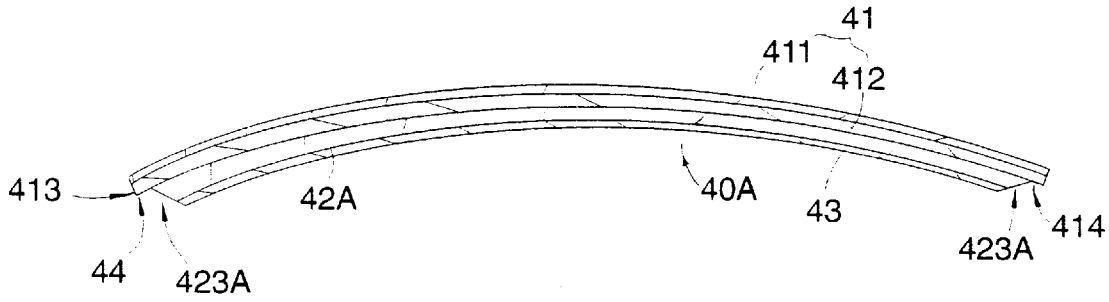
FIG. 7A is a sectional view of a first alternative cover panel of the present invention.

According to the present invention, various alternative modes for the cover panel 40 is illustrated in FIGS. 7A to 7D. The cover panel 40A as shown in FIG. 7A comprises a cushion layer 42A having a size slightly smaller than the cover layer 41 to form a surrounding rim 414 on the bottom surface of the cover layer 41 around inclined side edges 423A of the cushion layer 42A, so as to provide more room for the vertical covering side edges 413 to fit both the inclined sides 311 of the ribs 31 as shown in FIGS. 3 and 4 or the vertical sides 311' of the ribs 31' as shown in FIGS. 5 and 6, when a thicker cushion layer 42A is used.

Figure 7B:
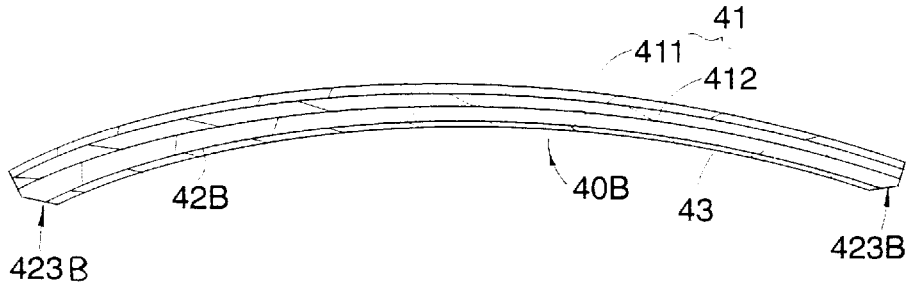
FIG. 7B is a sectional view of a second alternative cover panel of the present invention.

As shown in FIG. 7B, another alternative cover panel 40B is illustrated, wherein a top portion of each side edge 423B of the cushion layer 42B is vertically extended vertical while only a bottom portion of each side edge 423B of the cushion layer 42B is extended inclinedly.

Figure 7C:
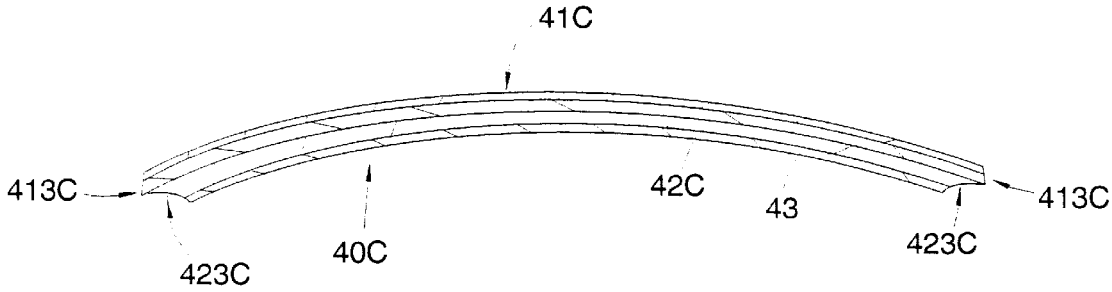
FIG. 7C is a sectional view of a third alternative cover panel of the present invention.

As shown in FIG. 7C, another alternative cover panel 40C is illustrated, wherein the covering side edges 413C of the cover layer 41 C can be made outwardly inclined to enable a easier fit of the side edges 413C with the sides 311 or 311' of the ribs 31 or 31' as mentioned above. Moreover, this alternative cover panel 40C also illustrates a cushion layer 42C having side edges 423C thereof are inclined in concave manner.

Figure 7D:
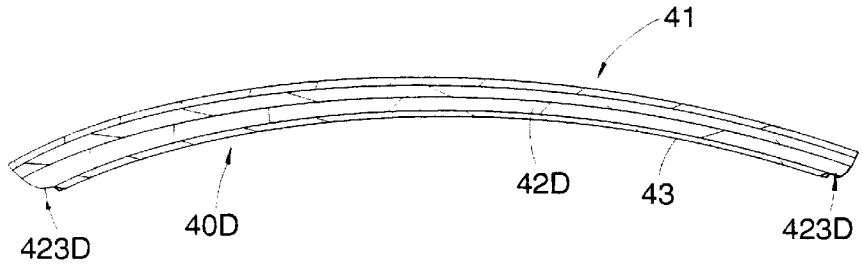
FIG. 7D is a sectional view of a fourth alternative cover panel of the present invention.

As shown in FIG. 7D, another alternative cover panel 40D is illustrated, wherein the inclined side edges 423D of the cushion layer 42D is curvedly made in convex manner In view of above, the present invention provides a basketball having a plurality of cover panels each of which comprising an additional foam layer attached to the conventional cover panel, so as to construct a basketball not only retaining the original characteristic of durable, hardness and toughness but also containing new characteristics of being easier to grip and having better rebounding feature. It is worth to mention that the basketball of the present invention is more durable and has a softer feeling to reduce the painful during ball passing and shooting, especially suitable for children, training players and amateur players.

What is claimed is:

1. A basketball, comprising:

a spherical bladder carcass which is a hollow rubber ball having a valve stem affixed thereto, said bladder carcass having a plurality of projection ribs integrally protruded and extended thereon to define a plurality of leaf shape panel recesses surrounding by said ribs, wherein each of said ribs is structured in wedge shaped and sides of said ribs are inclined sides so as to form two extending inclined edges for each of said panel recesses, so that each of said ribs has a slightly narrower root and a slightly wider top end, and a plurality of leaf shaped cover panels having a shape of each of said panel recesses adapted to adhere in said plurality of panel recesses respectively, each of said cover panels being adhered on a recess surface of said respective panel recess and comprising a cover layer having a plurality of covering side edges, a cushion layer made of foam material having a top surface integrally adhered to said cover layer and a bottom surface for adhering a lining cloth for firmly adhering to said recess surface, wherein each side edge of said cushion layer is inwardly inclined for fitting in said respective panel recess, wherein said inclined side edges of said cushion layer are pressed down to adhere on borders of said recess surface, and said covering side edges of said cover layer are pushed down to contact with said inclined sides of said ribs around said panel recess, so as to enable said covering side edges of said cover layer fittingly adhered with said inclined sides of said ribs.

2. The basketball as recited in claim 1 wherein said covering side edges of said cover layer are vertical side edges and a thickness substantially equal to a depth of said respective panel recess.

3. The basketball as recited in claim 1 wherein each of said cover layer comprises an outer coating layer and an inner lining layer integrally attached and supported under said outer coating layer.

4. The basketball as recited in claim 3 wherein said covering side edges of said cover layer are vertical side edges and a thickness substantially equal to a depth of said respective panel recess.

5. The basketball as recited in claim 3 wherein said covering side edges of said cover layer are inclined side edges.

* * * * *